US006544589B2

(12) United States Patent
Willis et al.

(10) Patent No.: US 6,544,589 B2
(45) Date of Patent: Apr. 8, 2003

(54) METHOD OF CONTROLLING DRYING STRESSES BY RESTRICTING SHRINKAGE OF CERAMIC COATING

(75) Inventors: John Willis, Malibu, CA (US); Thomas A. Seitz, Ellicott City, MD (US); Steven J. Null, Mission Viejo, CA (US); James W. Bohlen, Fountain Valley, CA (US); Michael L. Peters, Stevenson Ranch, CA (US); Blake T. Tatsuta, La Palma, CA (US)

(73) Assignee: Northrop Grumman Corporation, Los Angeles, CA (US)

( * ) Notice: Subject to any disclaimer, the term of this patent is extended or adjusted under 35 U.S.C. 154(b) by 0 days.

(21) Appl. No.: 09/933,359

(22) Filed: Aug. 20, 2001

(65) Prior Publication Data

US 2003/0035896 A1 Feb. 20, 2003

(51) Int. Cl.[7] ..... B05D 3/10; B05D 3/02

(52) U.S. Cl. ..... 427/344; 427/376.2; 427/397.8

(58) Field of Search ..... 427/376.2, 376.1, 427/337, 343, 344, 397.7, 397.8; 264/60, 64, 234, 345

(56) References Cited

U.S. PATENT DOCUMENTS

| | | | | |
|---|---|---|---|---|
| 3,755,204 A | | 8/1973 | Sergeys | 252/455 R |
| 3,900,622 A | | 8/1975 | Caramanian | 427/455 |
| 3,980,604 A | | 9/1976 | Whiting et al. | 260/30.4 |
| 3,985,846 A | | 10/1976 | Lundsager et al. | 264/44 |
| 4,091,148 A | | 5/1978 | Blankenhorn et al. | 427/314 |
| 4,272,894 A | * | 6/1981 | Salviati | 264/234 |
| 4,929,650 A | | 5/1990 | Kurauchi et al. | 523/455 |
| 5,082,878 A | | 1/1992 | Bansleben et al. | 523/203 |
| 5,112,698 A | | 5/1992 | Horvei et al. | 428/632 |
| 5,198,282 A | * | 3/1993 | Baker et al. | 264/257 |
| 5,422,141 A | | 6/1995 | Hoopes et al. | 427/299 |
| 5,460,854 A | | 10/1995 | Krug | 427/393.6 |
| 5,552,179 A | | 9/1996 | Ramun | 427/136 |
| 5,753,160 A | * | 5/1998 | Takeuchi et al. | 264/40.1 |
| 5,993,661 A | * | 11/1999 | Ruckenstein et al. | 210/231 |

FOREIGN PATENT DOCUMENTS

WO WO 8704442 7/1987

* cited by examiner

*Primary Examiner*—Michael Barr
(74) *Attorney, Agent, or Firm*—Stetina Brunda Garred & Brucker

(57) ABSTRACT

A method of controlling drying stresses through controlled shrinkage of a ceramic coating coated onto a substrate. The method first includes applying a non-cured ceramic coating onto the substrate and permitting the coating to dry until a mechanically stable outer surface layer of the coating is formed. Once this layer is formed, a drying control is applied in a quantity sufficient to penetrate into the surface layer, with the result of such application being the inhibition of formation of a dry outer skin as continued drying is permitted to occur. Once such drying is complete, the outer surface layer is subjected to an elevated temperature for curing and for evaporating therefrom the drying control agent to thereby produce a cured-ceramic coated substrate whose coating is void of large cracks and whose durability is beneficially opportune.

11 Claims, 1 Drawing Sheet

METHOD OF CONTROLLING DRYING STRESSES BY RESTRICTING SHRINKAGE OF CERAMIC COATING

STATEMENT OF GOVERNMENT RIGHTS

This invention was made with Government support under contract F33657-81-C-0067 awarded by the United States, Air Force. The Government has certain rights in this invention.

CROSS-REFERENCE TO RELATED APPLICATIONS (Not Applicable)

STATEMENT RE: FEDERALLY SPONSORED RESEARCH/DEVELOPMENT

BACKGROUND OF THE INVENTION

This invention relates in general to the application of ceramic coatings onto substrates, and in particular to methodology for controlling drying stress during shrinkage of a ceramic coating so applied through application of a drying control agent onto the outer surface of the coating after the coating is placed and minimally dried, and thereafter drying and heat-curing the coating.

Ceramic coatings are regularly applied to various substrates in a variety of product areas. One such product area is in aircraft construction, and includes such coatings on jet engine and engine exhaust components for thermal protection and energy absorption. One prior art method of coating placement involves the application of water-diluted, cement-based ceramic slurries by spraying or brushing the slurry to accomplish placement thereof, followed by ambient environment evaporation of the water of solution and final elevated-temperature curing to remove the water of hydration. The cements of the slurries typically are alkali metal silicates and bind together included ceramic oxides and energy absorbing fillers chosen for an intended application. The cement, or another compatible cement placed as a primer on the substrate, provides adhesion to the substrate.

Drying and curing a typical coating as described above results in volumetric reduction, i.e., shrinkage of the cement portion material and subsequent crack formation thereof. Cracking can also result from differences in thermal expansion of the substrate and the coating as well as from distortion or deformation of the substrate that may accompany heating and cooling thereof during a cure cycle. Once a crack penetrates the thickness of the coating, the crack then has a tendency to "curl" or branch into cracks parallel to the coating-substrate interface. Such parallel cracks can result in an immediate loss of coating during cool-down from a cure temperature as well as during use where thermal cycling or high vibration occurs.

Generally, the characteristics of cracks in cement-based coatings relate to the total amount of shrinkage that occurs during the loss of the water of hydration, and additionally relies upon the coated surface area, the coating thickness, and the coating strength and condition at the time when cracking occurs. The amount of shrinkage is related to the water of solution initially in the slurry, the water of hydration that is removed during curing, and the strength of the material that is resisting shrinkage when the water is removed. Material that is weak when cracking begins may form many small cracks, while a strong material may form one or more large cracks. Because drying typically occurs from the surface into the thickness of the coating, cracks tend to initiate at the surface during drying and curing and propagate through the: thickness as the water diffuses to the surface for exit. Both large cracks in the coating and loss of coating are usual causes for rejection of coated or would-be coated products. Thus, desirable coatings have either no cracks or very narrow cracks, with the latter many times advantageous depending upon required local flexure of the coating in accord with characteristics of the coated substrate.

In view of present-day inefficiencies of typical ceramic coated substrates, it is evident that a need is present for a method of coating such substrates which produces a product with an intact coating. Accordingly, a primary object of the present invention is to provide methodology for controlling drying stresses during shrinkage of a ceramic coating on a substrate.

Another object of the present invention is to provide coating methodology wherein a moisture preservation agent is applied onto the outer surface layer of the applied coating prior to complete drying and curing thereof.

These and other objects of the present invention will become apparent throughout the description thereof which now follows.

BRIEF SUMMARY OF THE INVENTION

The present invention is a method of controlling shrinkage and subsequent drying stresses of a ceramic coating coated onto a substrate. The method first includes applying a non-cured ceramic coating onto the substrate and permitting the coating to dry until a mechanically stable outer surface layer of the coating is formed. Once this stable outer surface layer is formed, a moisture control agent is generally uniformly applied onto the layer of the coating in a quantity sufficient to penetrate into the surface layer, with the result of such application being the inhibition of formation of a highly stressed dry outer skin as continued drying is permitted to occur. Once such drying is complete, the outer surface layer is subjected to an elevated temperature for curing and for evaporating therefrom the moisture preservation and drying control agent to thereby produce a cured-ceramic coated substrate whose coating is void of large cracks and whose durability is enhanced.

Operationally, the application of the moisture preservation agent prevents formation of a weak, dry crust or skin during ambient drying of the coating. In particular, the agent combines with suspension water in the outer layer of the coating to thereby displaces water at the surface, limit dehydration, and reduce the gradient in water content through the thickness of the coating. This reduced gradient evens out shrinkage throughout the thickness of the coating both during ambient-environment drying and early-stage elevated-temperature curing. During curing of the coating, and because of its outer surface-layer modification, the drying control agent acts to delay curing of the outer surface thereof to thereby ward off associated shrinkage and distributes drying stresses. This delay slows onset of cracking, provides more uniform curing throughout the thickness of the coating, and produces healing of any cracks that do form by causing a flow of material from the outer layer into the cracks. Continued elevated temperature exposure during the cure process evaporates the moisture preservation agent which ultimately results in allowing the cure of the outer layer. The resulting coating has minimal curling and has narrow cracks at most without any significant branching thereof parallel to the so-coated substrate, thus producing a coating with quality and durability during thermal reactivity.

BRIEF DESCRIPTION OF THE DRAWINGS

An illustrative and presently preferred embodiment of the invention is shown in the accompanying drawings in which.

DETAILED DESCRIPTION OF THE PREFERRED EMBODIMENT

Figure 1:
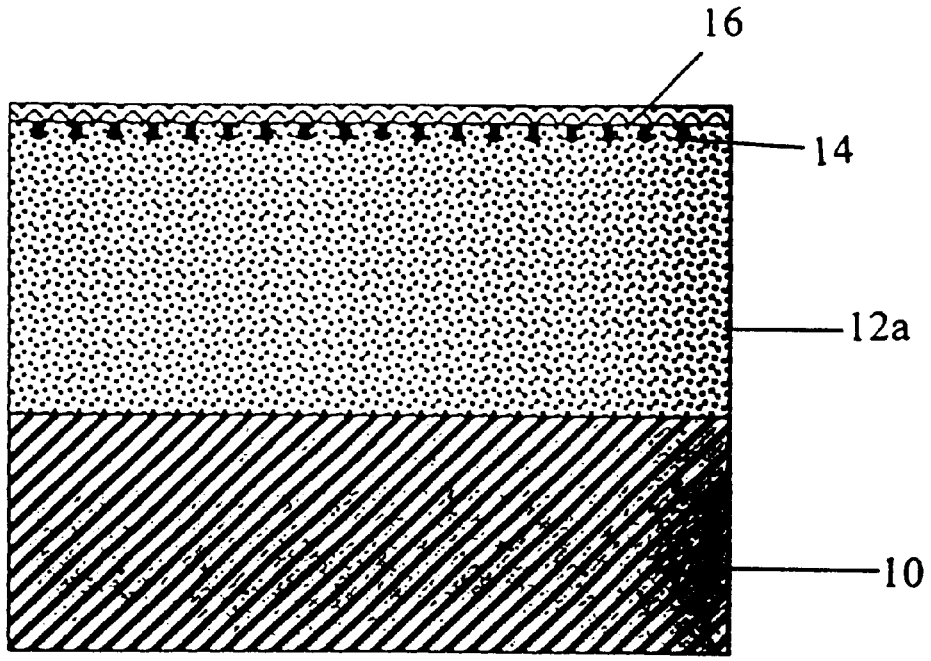
FIG. 1 is a side elevation view in section of a non-cured silicate cement coating applied onto a substrate.
Figure 2:
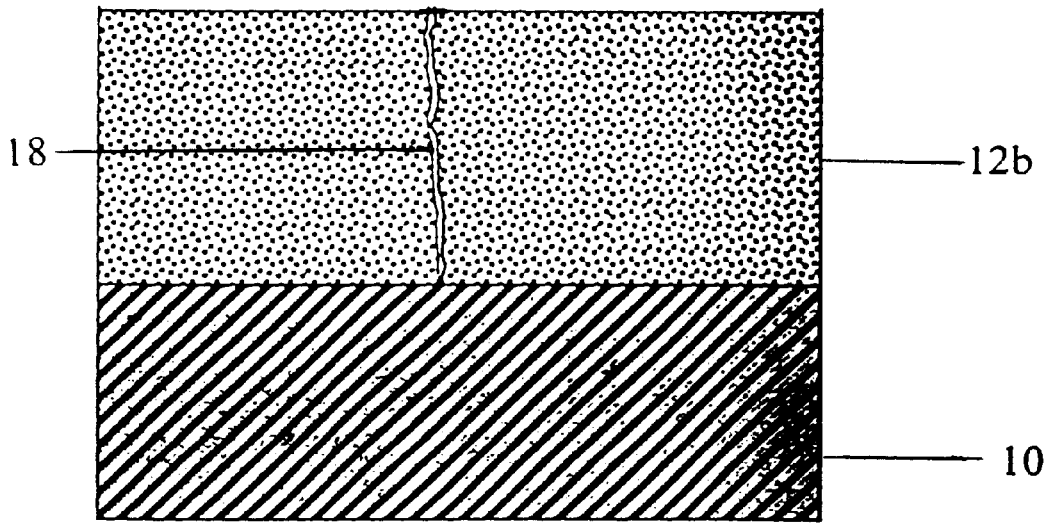
FIG. 2 is a side elevation view in section of the silicate cement coating applied onto the substrate as in FIG. 1 after the silicate cement coating is cured.

Referring first to FIG. 1, a substrate 10 is shown with a non-cured silicate cement coating 12*a* applied thereon. The coating 12*a* is partially dried (about one hour in ambient conditions) to form a mechanically stable outer surface layer 14 upon which a moisture preservation and drying control agent 16 then is generally uniformly applied by brushing onto the outer surface layer 14. The agent 16 is here shown prior to its penetration into the coating 12*a* up to about 0.010 inch and preferably is a mixture of glycerol and propylene glycol, most preferably in a 1:1 or 7:3 ratio by volume. Where a 1:1 ratio of glycerol and propylene glycol is chosen, continued ambient drying is permitted to occur for five to six additional hours, whereupon curing at an elevated temperature as dictated by the requirements of the particular ceramic material of the coating 12*b* proceeds to completion as depicted in FIG. 2. Any cracks 18 formed within the coating 12*b* are one-half or less the width of an identical procedure but without application of the drying control agent 16. Further, no curling develops and no cracks parallel to the substrate 10 occur. Where a 7:3 ratio of glycerol and propylene glycol is chosen, similar results are obtained when a curing step having longer cure time or higher cure temperature is employed for elimination of the increased amount of glycerol. In this manner, a durable, ceramic-coated substrate-product is produced for longevity and dedicated use in high thermally-variable environments which are especially exemplified in aircraft engine components.

While an illustrative and presently preferred embodiment of the invention has been described in detail herein, it is to be understood that the inventive concepts may be otherwise variously embodied and employed and that the appended claims are intended to be construed to include such variations except insofar as limited by prior art.

What is claimed is:

1. A method of controlling drying stress during shrinkage of a ceramic coating coated onto a substrate, the method comprising the sequential steps of:

a) applying a non-cured silicate ceramic coating onto the substrate and permitting the coating to dry until an outer surface layer of the coating is formed;

b) applying a drying control agent comprised of glycerol and propylene glycol generally uniformly onto the outer surface layer of the coating in a quantity sufficient to penetrate into said surface layer for inhibiting formation of a dry outer skin during drying and thereafter continuing said drying; and c) subjecting the outer surface layer to an elevated temperature for curing said surface layer and evaporating therefrom the drying control agent.

2. A method of controlling shrinkage as claimed in claim 1 wherein the quantity of drying control agent applied onto the outer surface layer is limited to permit penetration to 0.010 inch.

3. A method of controlling shrinkage as claimed in claim 1 wherein a mixture by volume of glycerol and propylene glycol is 1:1.

4. A method of controlling shrinkage as claimed in claim 1 wherein a mixture by volume of glycerol and propylene glycol is 7:3.

5. A method of controlling drying stress during shrinkage of a silicate ceramic coating coated onto a substrate, the method comprising the steps of:

a) forming an outer surface layer of the silicate ceramic coating on the substrate;

b) applying a drying control agent comprised of glycerol and propylene glycol onto the outer surface layer;

c) drying the outer surface layer;

d) preventing a dry outer skin from being formed when the outer surface layer is dried;

e) curing the outer surface layer; and f) evaporating the drying control agent from the outer surface layer.

6. The method of claim 5 wherein step a) comprises:

1) applying a non-cured silicate ceramic coating onto the substrate; and 2) drying the coating until the outer surface layer is formed.

7. The method of claim 5 wherein step b) comprises forming the drying control agent with a 1:1 mixture by volume of glycerol and propylene glycol.

8. The method of claim 5 wherein step b) comprises forming the drying control agent with a 7:3 mixture by volume of glycerol and propylene glycol.

9. The method of claim 5 wherein step b) comprises applying the drying control agent uniformly onto the outer surface layer.

10. The method of claim 5 wherein step d) comprises penetrating into the outer surface layer with the drying control agent.

11. The method of claim 10 wherein the penetration of the drying control agent into the outer surface layer is about 0.010 inch.

* * * * *